US008251723B2

(12) United States Patent
Tsai

(10) Patent No.: US 8,251,723 B2
(45) Date of Patent: Aug. 28, 2012

(54) INTERCONNECTION SYSTEM INCORPORATED WITH MAGNETIC ARRANGEMENT

(75) Inventor: Tzu-Ching Tsai, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 281 days.

(21) Appl. No.: 12/773,027

(22) Filed: May 4, 2010

(65) Prior Publication Data

US 2010/0279517 A1 Nov. 4, 2010

(30) Foreign Application Priority Data

May 4, 2009 (TW) ..... 98114728

(51) Int. Cl.
*H01R 27/00* (2006.01)

(52) U.S. Cl. ..... 439/218; 439/108

(58) Field of Classification Search ..... 439/101, 439/103, 106, 108, 171, 172, 174, 217, 218, 439/221, 223
See application file for complete search history.

(56) References Cited

U.S. PATENT DOCUMENTS

| | | | | |
|---|---|---|---|---|
| 4,429,935 | A * | 2/1984 | Lamb et al. | 439/221 |
| 5,017,818 | A * | 5/1991 | Dohogne | 439/217 |
| 6,863,549 | B2 * | 3/2005 | Brunker et al. | 439/108 |
| 6,969,268 | B2 * | 11/2005 | Brunker et al. | 439/108 |
| 7,114,979 | B1 * | 10/2006 | Lai | 439/103 |
| 7,264,509 | B1 * | 9/2007 | McAlonis et al. | 439/607.07 |
| 7,311,526 | B2 * | 12/2007 | Rohrbach et al. | 439/218 |
| 7,591,684 | B2 * | 9/2009 | Zhang et al. | 439/108 |
| 7,963,777 | B2 * | 6/2011 | Tang et al. | 439/80 |
| 2011/0192640 | A1 * | 8/2011 | Liu | 439/78 |

* cited by examiner

*Primary Examiner* — Felix O Figueroa
(74) *Attorney, Agent, or Firm* — Wei Te Chung; Andrew C. Cheng; Ming Chieh Chang

(57) ABSTRACT

An electrical connector assembly includes a first connector and a second connector each defining a mating end of a regular polygon mating with each other. Each regular polygon defines a center, an imaginary circle around the center and a plurality of vertices at the imaginary circle. A plurality of pins are located at the mating ends which composed of one first pin at the center of the first connector, two second pins at least fulfilling with one half of the vertices and arranged at adjacent vertices in turn, one third pin at the center of the second connector and two forth pins at the vertices respectively in a condition that said two forth pins spaced from each other with a largest distance.

15 Claims, 10 Drawing Sheets

INTERCONNECTION SYSTEM INCORPORATED WITH MAGNETIC ARRANGEMENT

BACKGROUND OF THE INVENTION

1. Field of the Invention

The present invention relates to an interconnection system, and more particularly, to an interconnection system incorporated with magnetic arrangement facilitating quick attachment and release therebetween.

2. Description of Related Art

Electronic devices, such as laptop computers, typically use DC power supplied from a transformer connected to a conventional AC power supply. U.S. Pat. No. 7,311,526 issued on Dec. 25, 2007 to Apple Inc. discloses a magnetic connector for electronic device. According to its disclosure, an electrical plug and receptacle relying on magnetic force to maintain contact are disclosed. The plug and receptacle can be used as part of a power adapter for connecting an electronic device, such as a laptop computer, to a power supply. The plug includes electrical contacts, which are preferably biased toward corresponding contacts on the receptacle. The plug and receptacle each have a magnetic element. The magnetic element on one or both of the plug and receptacle can be a magnet, which is preferably a permanent rare earth magnet although electromagnets may also be used. The magnetic element on the plug or receptacle that does not include a magnet is composed of ferromagnetic material. When the plug and receptacle are brought into proximity, the magnetic attraction between the magnet and its complement, whether another magnet or a ferromagnetic material, will attract to each other as so to maintain the contacts in an electrically conductive relationship. The plug and the receptacle mates with each other in two orientations.

SUMMARY OF THE INVENTION

Accordingly, an object of the present invention is to provide an electrical connector assembly with a regular polygon mating end which mating with each other regardless of orientations thereof.

In order to achieve the above-mentioned object, an electrical connector assembly comprises a first connector and a second connector each defining a mating end of a regular polygon mating with each other. Each regular polygon defines a centre, an imaginary circle around the centre and a plurality of vertices at the imaginary circle. A plurality of pins are located at the mating ends which composed of one first pin at the centre of the first connector, two second pins at least fulfilling with one half of the vertices and arranged at adjacent vertices in turn, one third pin at the centre of the second connector and two forth pins at the vertices respectively in a condition that said two forth pins spaced from each other with a largest distance.

Other objects, advantages and novel features of the present invention will become more apparent from the following detailed description of the present embodiment when taken in conjunction with the accompanying drawings.

DETAILED DESCRIPTION OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Figure 1:
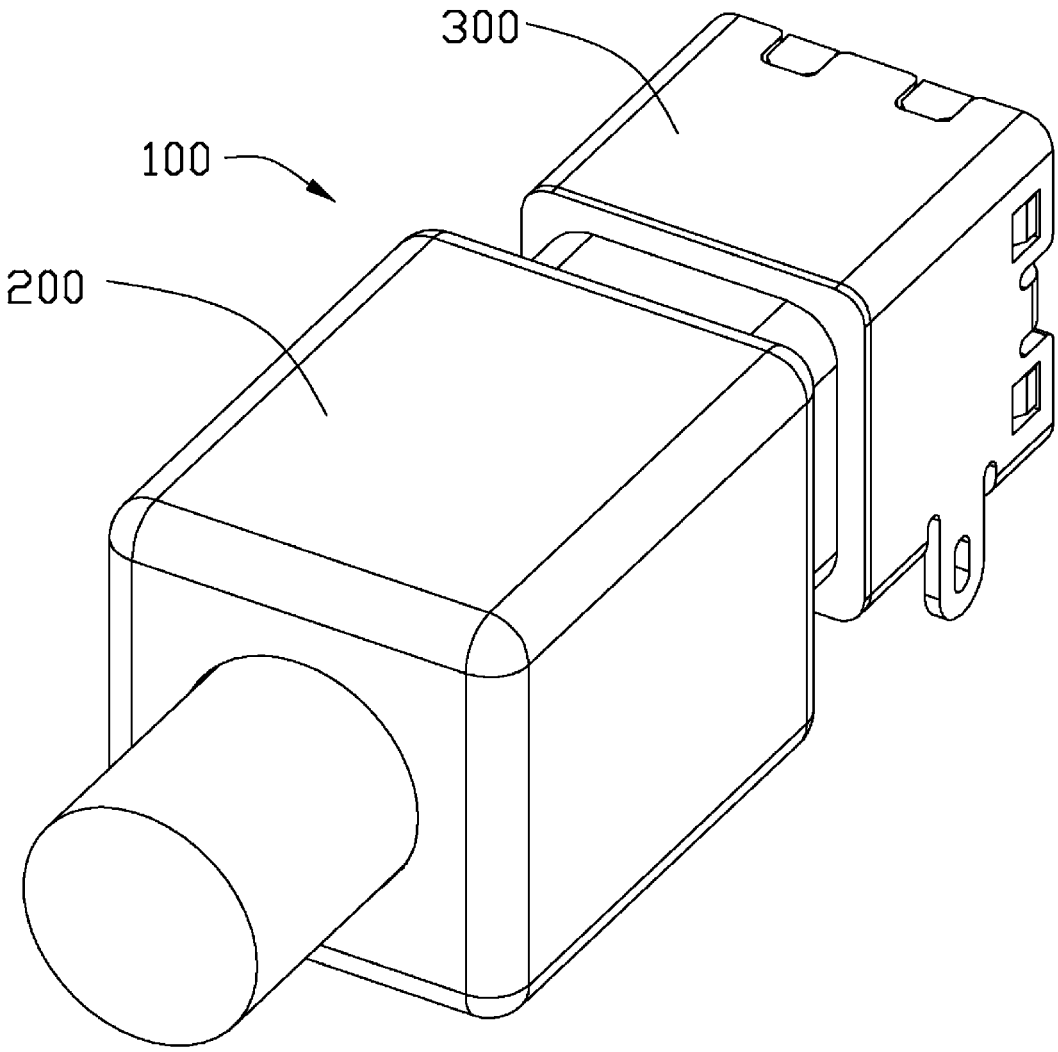
FIG. 1 is a perspective view of an electrical connector assembly according to an embodiment of the present invention, wherein the plug and the receptacle mate together.
Figure 2:
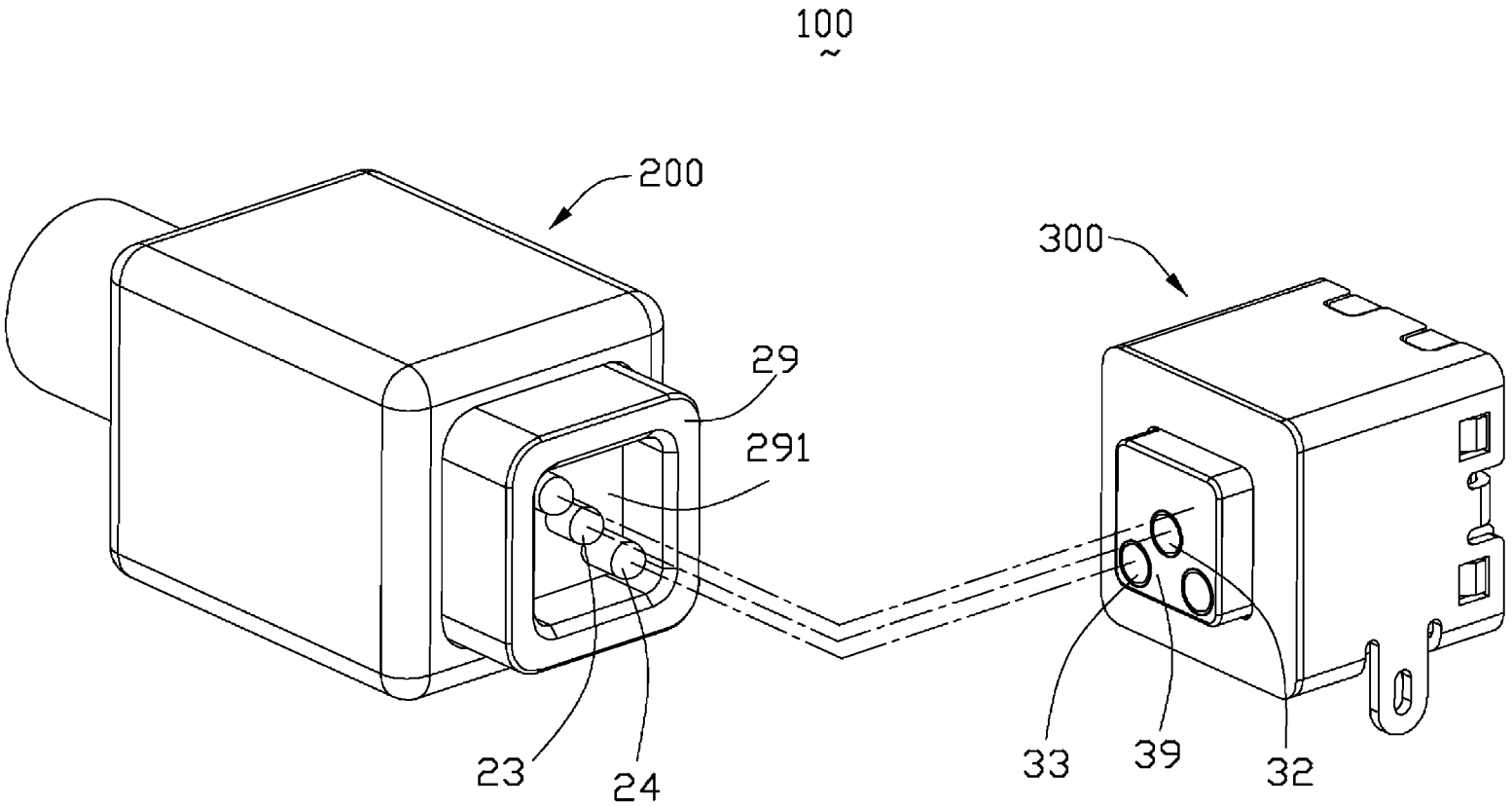
FIG. 2 is a perspective view of the electrical connector assembly in FIG. 1, wherein the plug and the receptacle disconnect from each other.

Referring to FIGS. 1 and 2, an embodiment of a magnetic connector assembly 100 according to certain teachings of the present disclosure is illustrated. The magnetic connector assembly 100 includes a first connector or plug 200 and a second connector or receptacle 300 coupled with each other. The plug 200 is connectable to power supply, such as cable end of transformer, while the receptacle 300 is connectable to an electronic device, such as laptop computer. The plug 200 has a recessed mating end 29 and three pins 23, 24 in the mating end 29. The receptacle 300 has a projecting mating end 39 and three terminals 32, 33 receiving in the mating ends.

Figure 3:
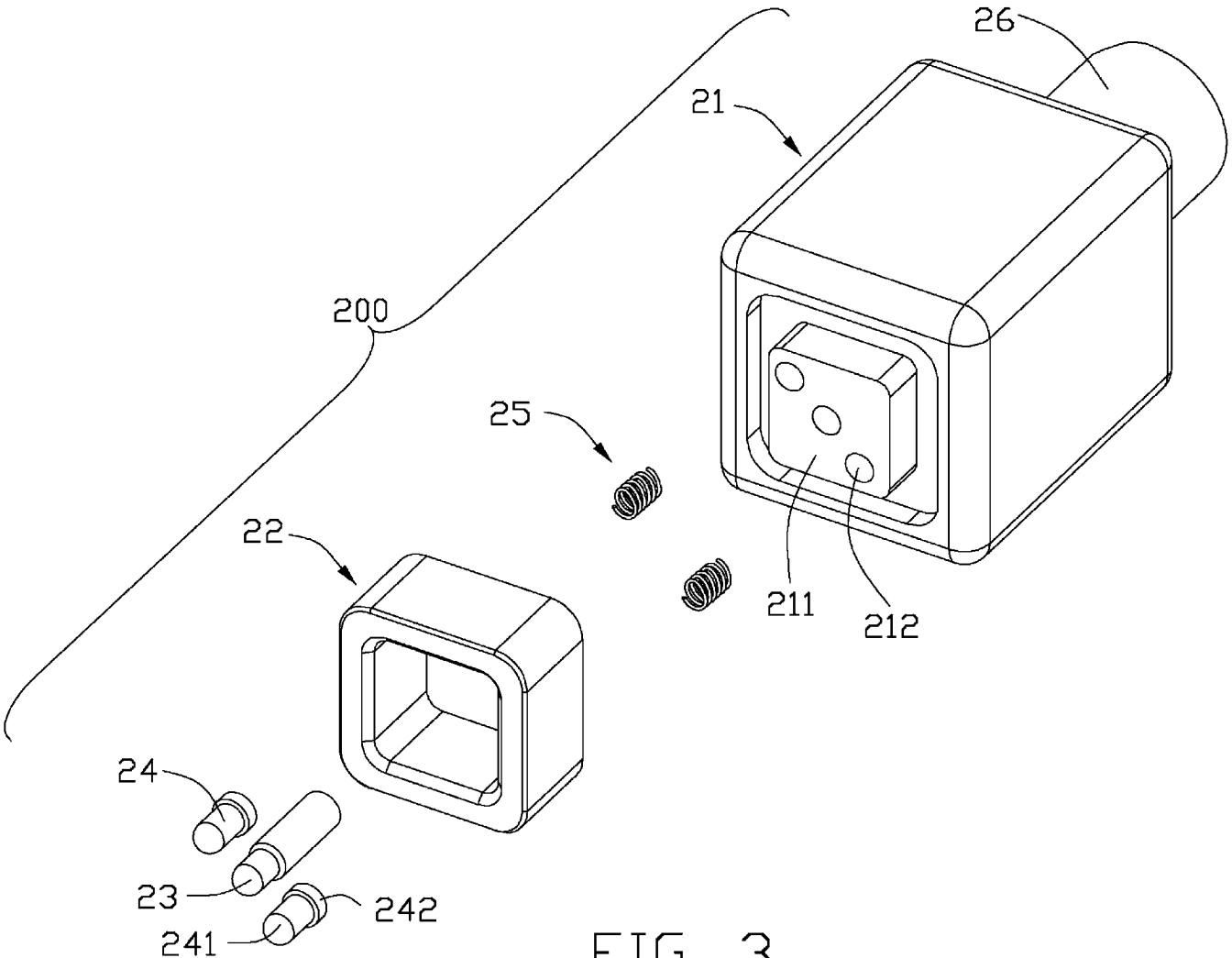
FIG. 3 is an exploded perspective view of the plug of FIG. 2.
Figure 4:
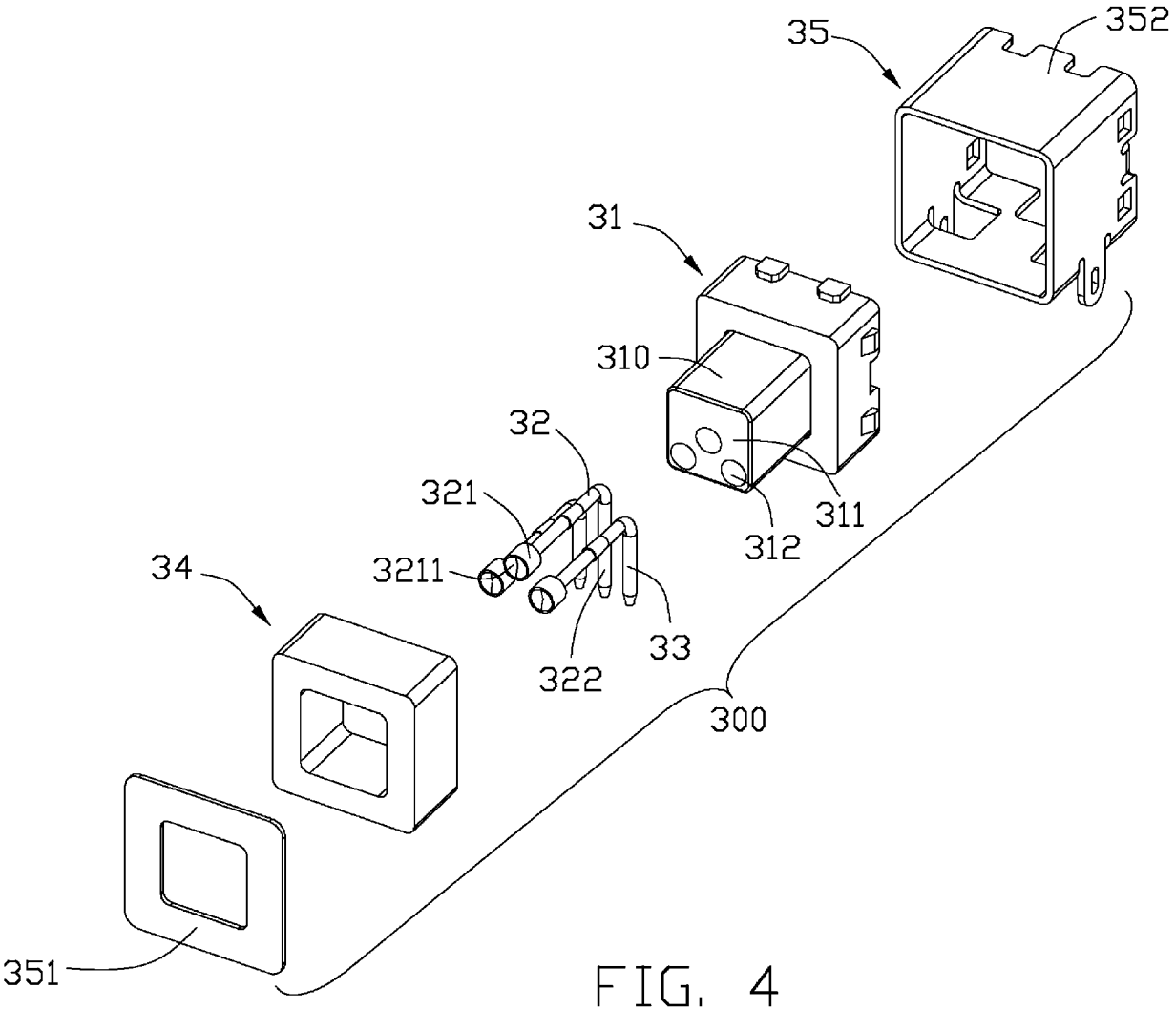
FIG. 4 is an exploded perspective view of the receptacle of FIG. 2.

Referring to FIG. 3, the plug 200 includes a plug body 21 having a front face 211 and connected to a cable 26. Preferably, the body 21 is composed of a conventional non-conductive material. The body 21 houses internal wires (not shown) of the cable 26. Three holes 212 are defined running through the front face 211 of the body 21. Said three pins 23 of the plug are held in the holes 212 respectively and each has a mating end 241 projecting out the front face 211 and an abutting end 242 opposite the mating end. The middle pin 23 or the first pin is a positive contact and said two outer pins or the second pins 24 are negative contacts. The abutting ends 242 of the second pins have general circular bases for abutting against one spring means 25 respectively which are located on the bottom of the hole 212 to bias the second pins 24 so that the second pins 24 extend from the front face 211 of the plug body 21. A square metal ring 22 is set on the front face 211 and surrounds the pins, which is used to protect pins and define said recessed mating end 29 configured with a mating recess 291 among the inside of the metal ring 22. Moreover, the metal ring 22 is served as a first magnetic element when the second magnet element 34 of the receptacle 300 closes to the metal ring.

Figure 5:
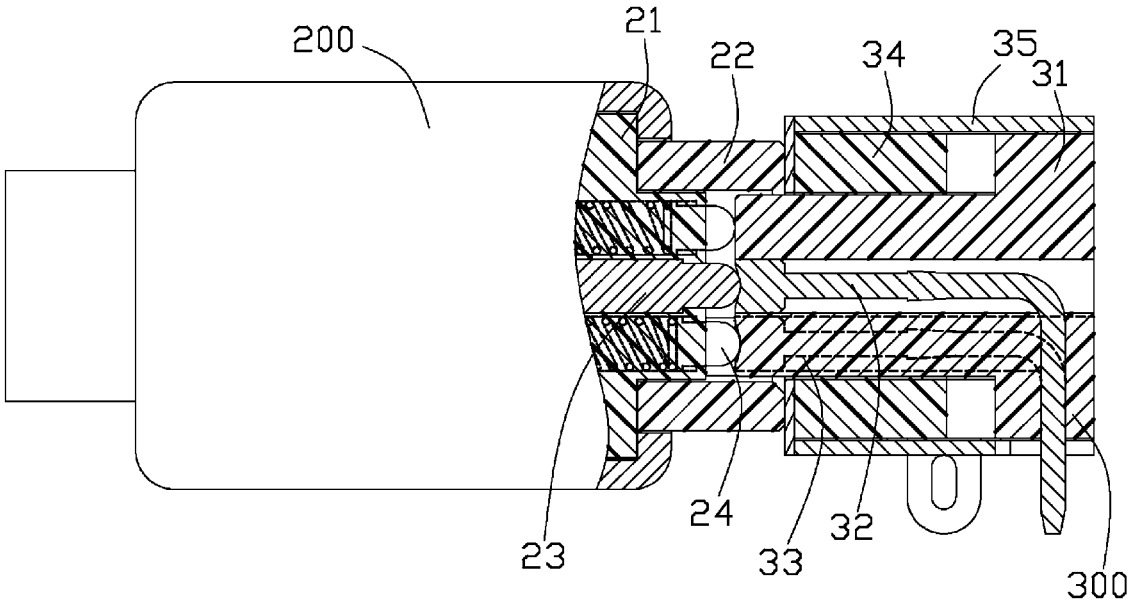
FIG. 5 is a sectional exploded side elevation view of the electrical connector assembly of FIG. 1.

The receptacle 300 has a body 31 having a front face 311. The body has a mating projection 310 and three holes 312 running through the face 311. Three pins 32, 33 are held in the holes and each pin includes a mating end 321 and a solder portion 322. The mating ends are aligned with the front face 311. The mating end 321 has an arc recess 3211 at the front face thereof so that the mating ends of the plug can be captured in the arc recess 3211. The second magnetic element 34 of ring shape is set around the mating projection 310. A front metal shell 351 covers the magnetic element 34 and a rear metal shell 352 surrounds the body 31. Thus the magnetic element 34 is sandwiched between the front metal shell 351 and the body 31. The mating end 39 with pins projects beyond the front metal shell 351. As best shown in FIGS. 2 and 5, the mating end 39 of the receptacle is inserted in the mating recess 291 of the plug and the front face 311 of the receptacle 300 is positioned against the front face 211 of the plug 200. The attractive force between the first and the second magnetic elements holds the plug 200 to the receptacle 300. The magnetic element 34 is permanent magnet.

Figure 6:
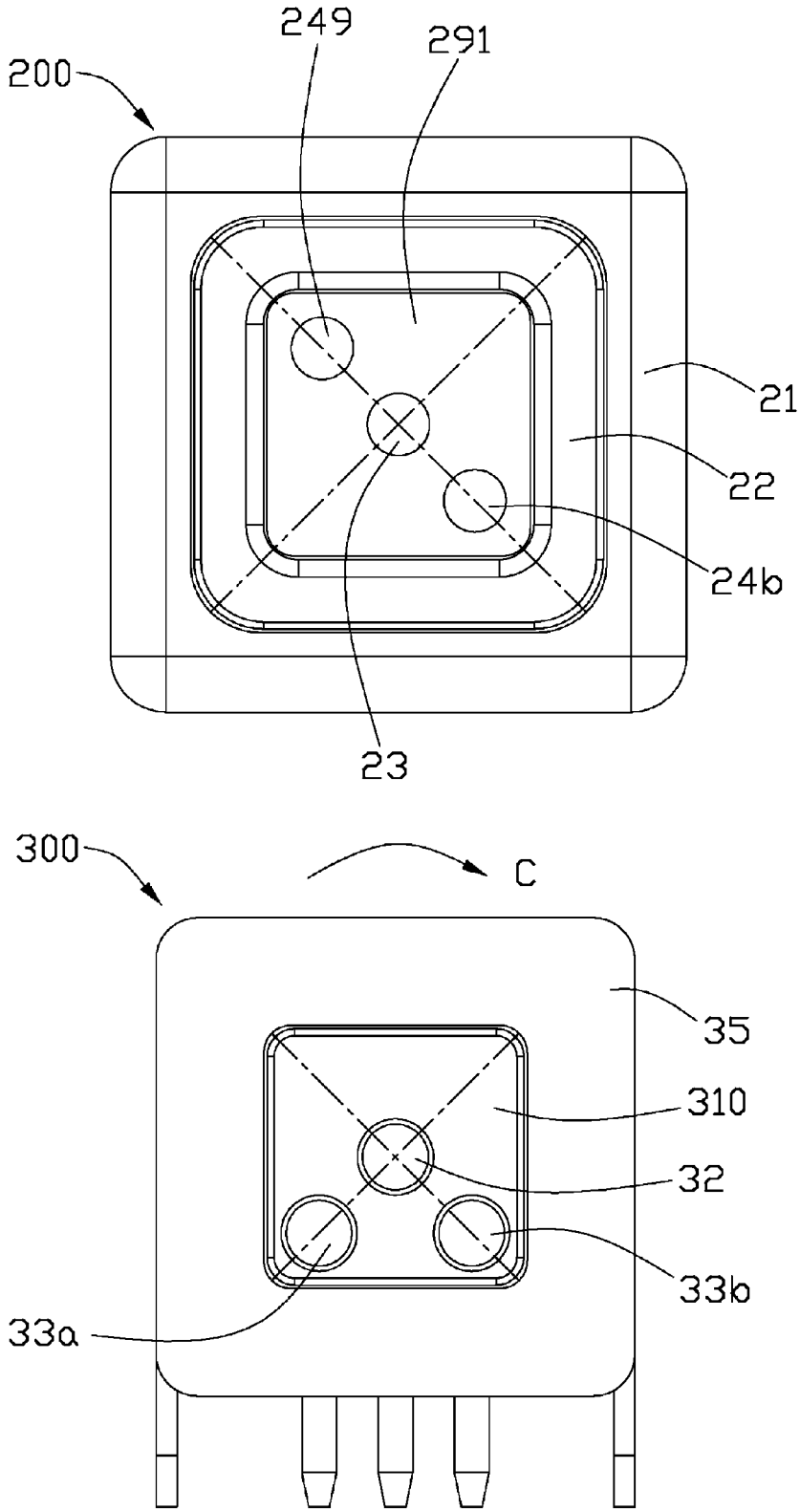
FIG. 6 is a front plan view of the plug and the receptacle of FIG. 2.

As best shown in FIG. 6, the front plane view of the mating recess 291 is of square and is illustrated with two diagonal lines shown in dash lines. The first pin 23 are located at an intersection of said two diagonal lines, i.e., at the centre of the mating recess 291, while said two second pins 24*a*, 24*b* are located on one diagonal line at two sides of the first pin 23 with an equal distance. The mating projection 310 is configured to conform to the mating recess 291 of the plug and has two diagonal lines shown in dash lines. The third pin 32 of the receptacle is at the centre of mating projection and two forth pins 33*a*, 33*b* are located at different diagonal lines respectively. The forth pin 33*a*, 33*b* spaces away from the third pin 32 with an equal distance. When mating of the plug 200 and the receptacle 300, for example the receptacle 300 rotate upwards in the figure sheet to mate with the plug 200, the first and third pins 23, 32 engage with each and one second pin 24*a* and one forth pin 33*a* engage with each other, while the other second pin 24*b* and forth pin 33*b* are in staggered position, i.e., not engage with each other. When the plug 300 is inserted in the receptacle in a manner with 90 angle rotation as shown in arrow C, the first and third pins 23, 32 also mates with each other and the second and forth pins 24*a*, 33*b* are engaged with each other and the third and forth pins 24*b*, 33*a* are in staggered position. The plug 200 can engage with the receptacle 200 in four orientations, regardless of which of the four orientations the plug and receptacle are coupled.

Figure 7:
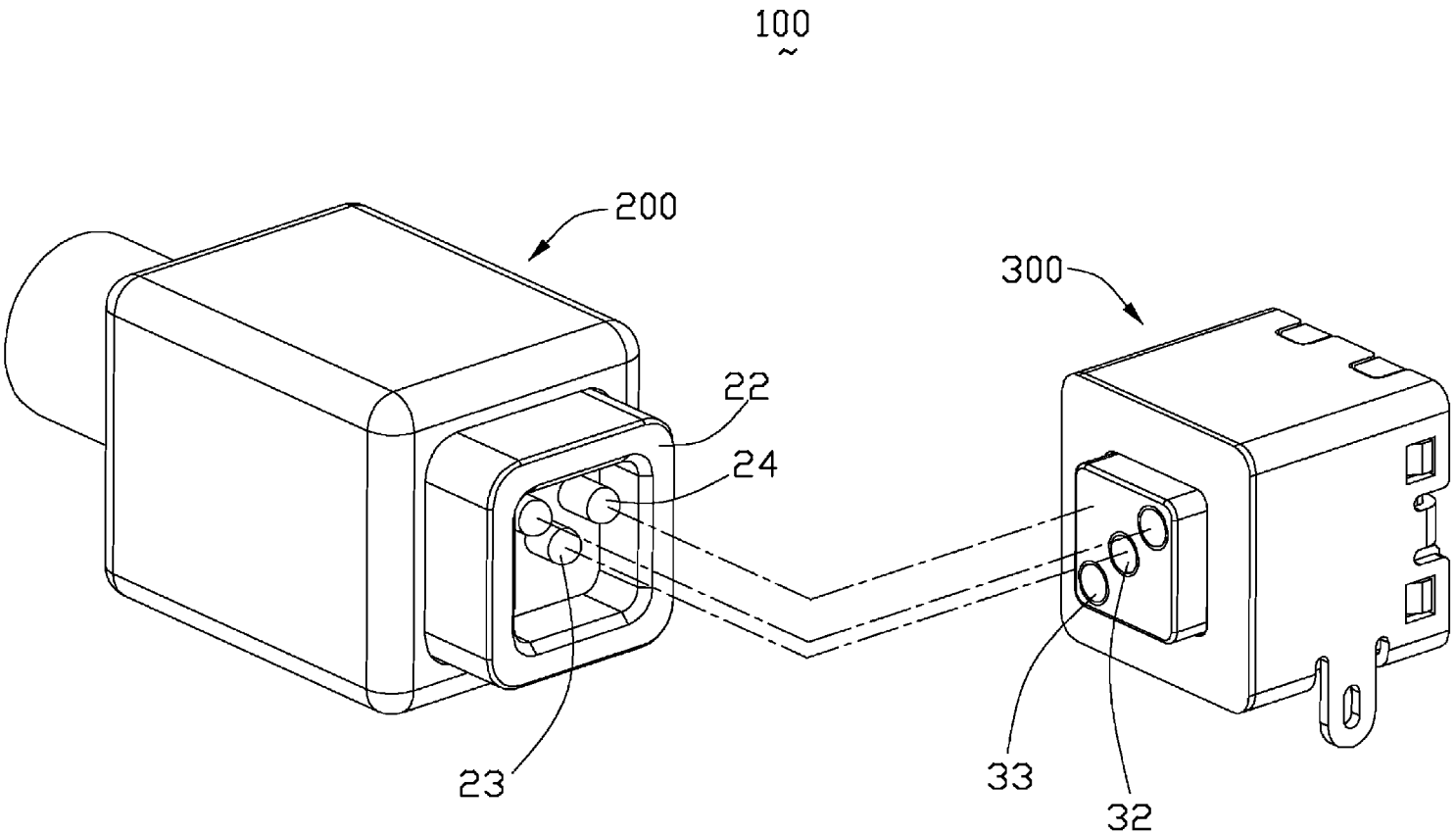
FIG. 7 is a perspective view of an electrical connector assembly according to a second embodiment of the present invention.

FIG. 7 illustrates a second embodiment that the arrangement of the pins of the plug and receptacle swap for each other. The second pins 24 of the plug 200 are located at corners at one side of the mating ends while the forth pins 33 of the receptacle 300 is located at the diagonal corner.

Other embodiments of the mating ends 29, 39 of the plug 200 and receptacle 300 are given wherein description of the pins and bodies are omitted since they are similar to said two embodiment.

Figure 8:
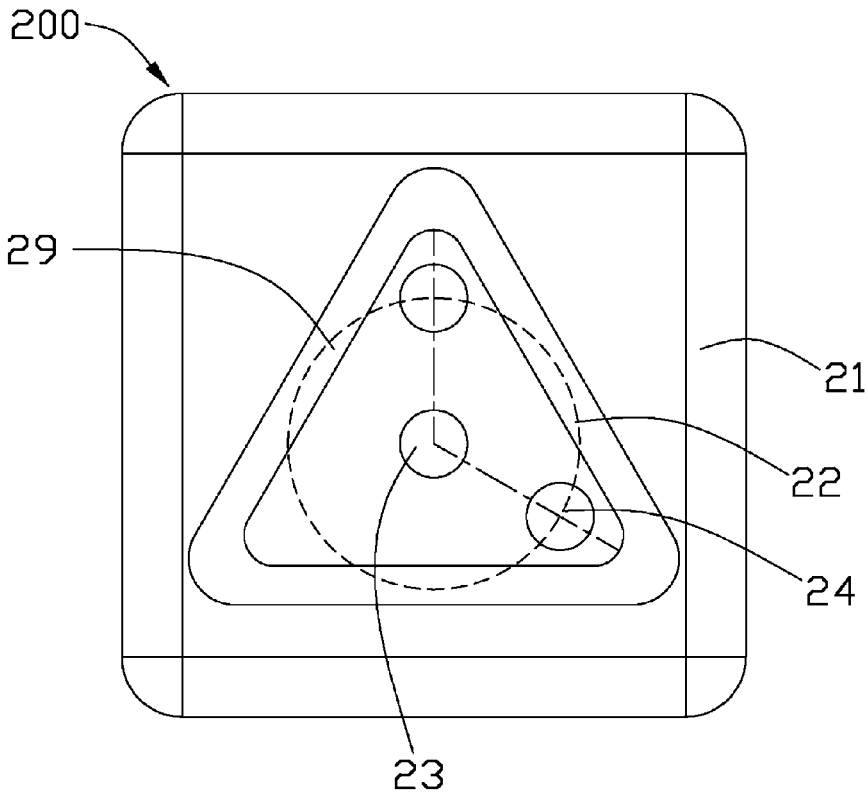
FIGS. 8~10 are front plan views of the plugs and the receptacles of different embodiments.
Figure 8:
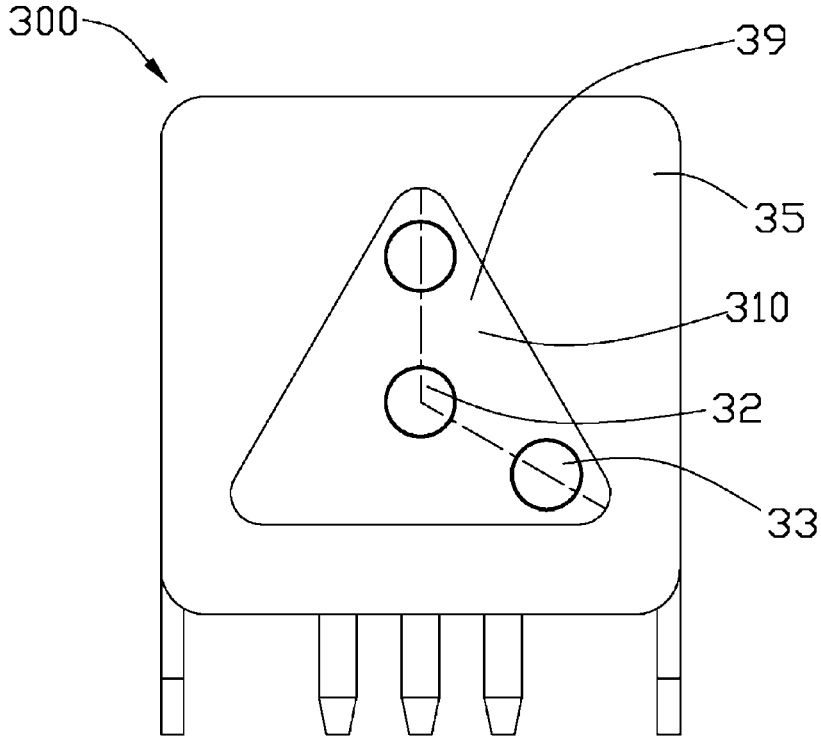

In one embodiment shown in the front view of FIG. 8, the mating ends 29, 39 of the plug 200 and the receptacle 300 are of an isosceles triangle. The first and third pins 23, 32 are located at the centre of the isosceles triangle. The two third and forth pins 24, 33 are respectively at any two of the three vertices of the isosceles triangle with a same distance, i.e., the isosceles triangle has an imaginary circle shown in broken lines and the pins are located at the imaginary circle and aligned with the vertices. The mating ends 291, 391 can engage with each other in three orientations, regardless of which of the three orientations the plug and receptacle are coupled. In embodiment, the imaginary circle design as large as possible to enlarge the distance between the vertices and the centre on the basis that the pins are in the mating ends. Thus, reliable force between the plug and the receptacle can be improved.

Figure 9:
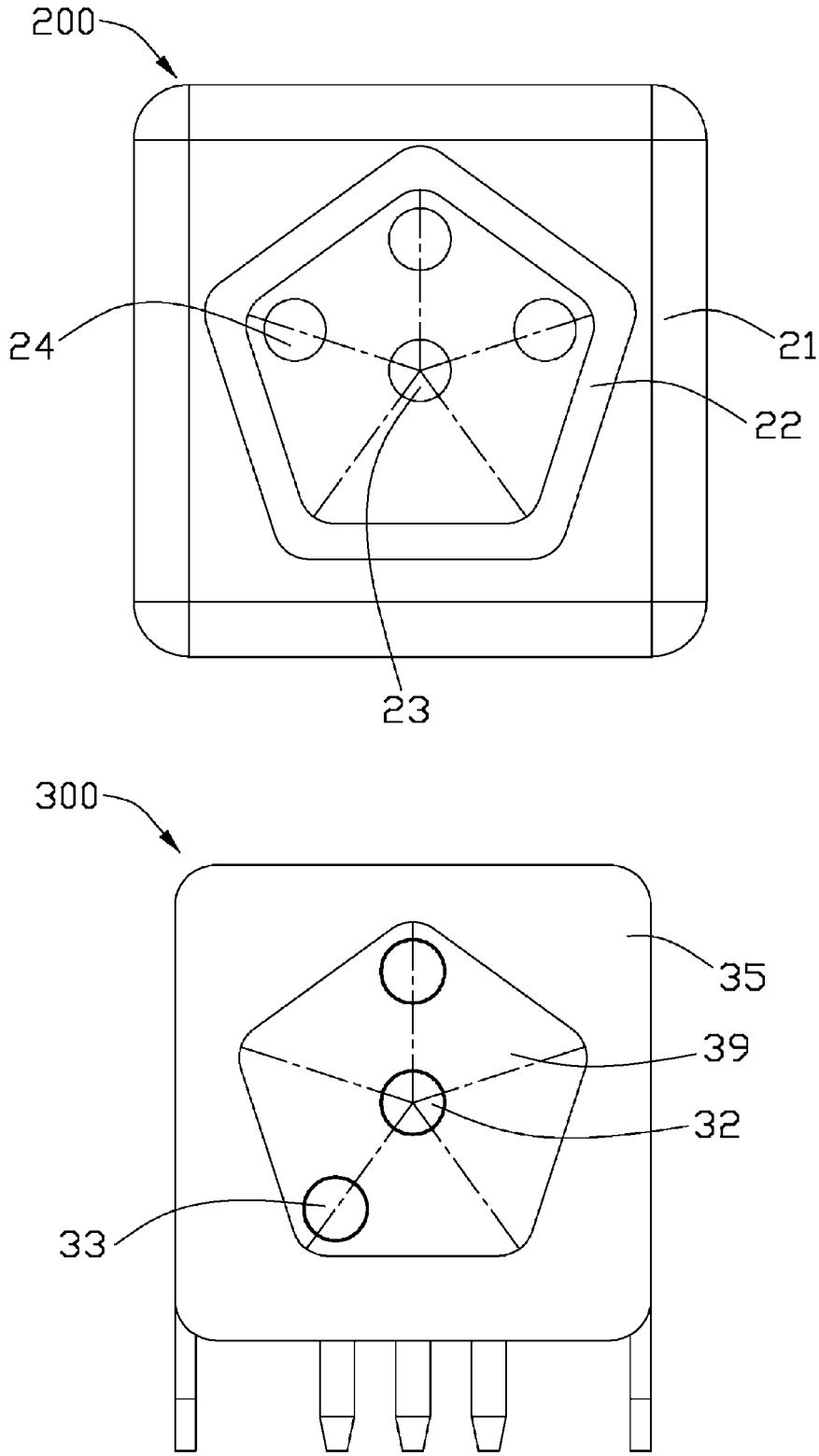

In one embodiment shown in the front view of FIG. 9, the mating ends 29, 39 of the plug 200 and the receptacle 300 are of a regular pentagon. The first pin 23 of the plugs 200 is located at the centre of the regular pentagon and three second pins 24 are respectively at three adjacent vertices of the five vertices in an imaginary circle of the regular pentagon. The third pin 32 of receptacle 300 is at the centre of the regular pentagon and two forth pins 33 intersperse at the two spaced vertices. The mating ends 29, 39 can engage with each other in five orientations, regardless of which of the five orientations the plug and receptacle are coupled.

Figure 10:
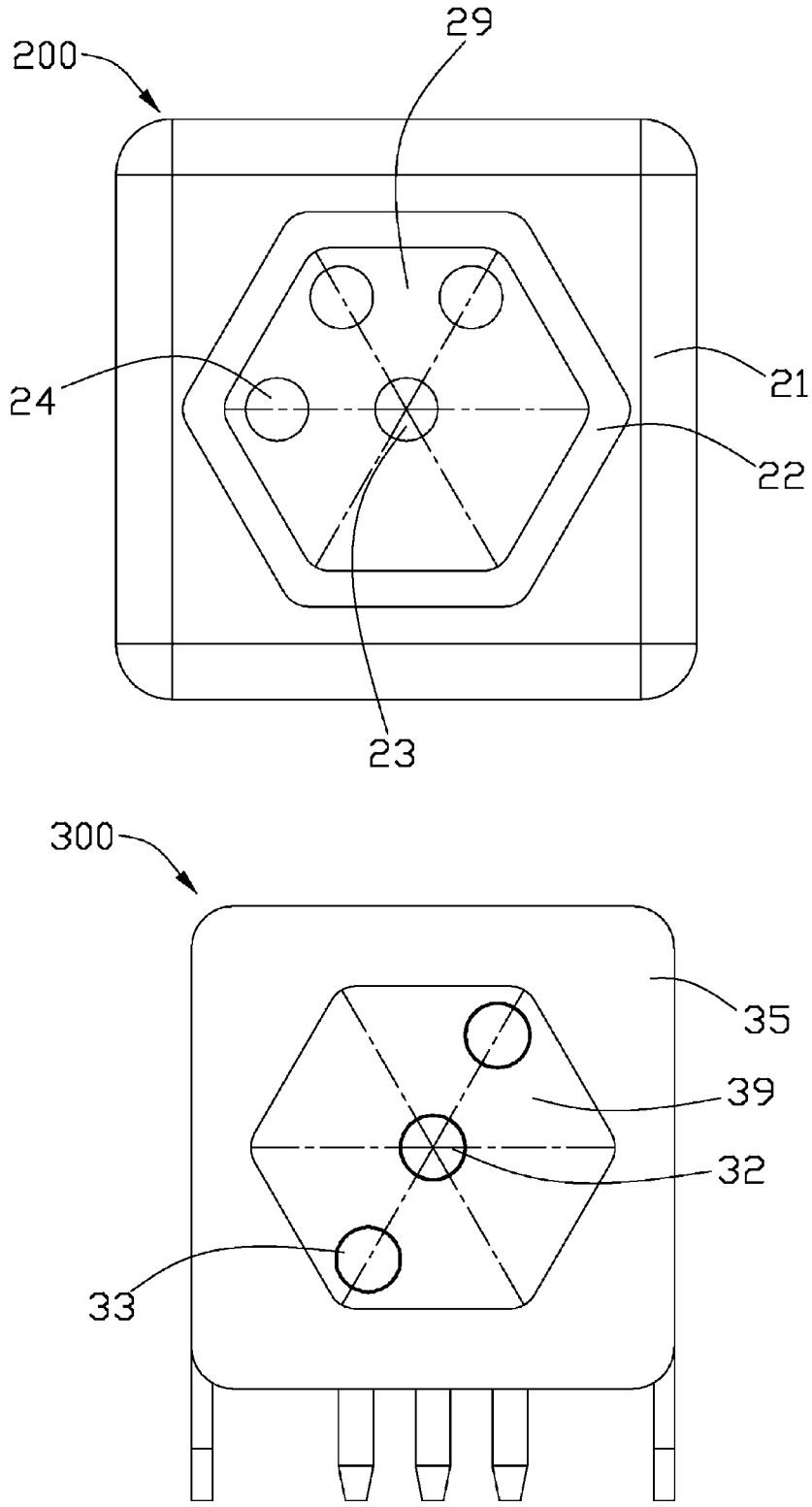

In one embodiment shown in the front view of FIG. 10, the mating ends 29, 39 of the plug 200 and the receptacle 300 are of a regular hexagon. The first pins 23 of the plugs is located at the centre of the regular hexagon and three second pins 24 are respectively at three adjacent vertices of the six vertices in an imaginary circle of the regular hexagon. The third pin 32 and forth pins of receptacle 300 are at one diagonal line, i.e., the forth pins are at two vertices in a condition that the forth pins spaced from each other with a largest distance. The mating ends 29, 39 can engage with each other in six orientations, regardless of which of the six orientations the plug and receptacle are coupled.

With the above understanding in relation to FIGS. 7~10, it can be seen that the first pin 23 and the third pin 32 has only one pin no matter how many sides of the regular polygon since the first pin 23 and the third pin 32 are positive contacts mating with each other, and the forth pins 32 has two pins. When the regular polygon with N sides (N is Even and N>2), the forth pins 33 are at the vertices of the one diagonal line across the centre in a diametrically opposite manner. When the regular polygon with N sides (N is Odd number and N>2), one of the forth pins at one vertex and the other of the forth pin is at the vertex nearest to the imaginary extending line from the line connecting said one vertex and the centre which ensure then forth pins space from each other with a largest distance. In a summary, said two forth pins are located in a condition that the forth pins are spaced with a largest distance around the imaginary circle. The number of the second pins 24 is not smaller than one half of N and the second pins are located at adjacent vertices in turn. Thus, the plug 200 and the receptacle 300 mate with each regardless of the orientation only limited by the regular polygon and at least one pair of the second pin and the forth mated with each other. Moreover, said arrangement of the first~forth pins ensure one pair of the pins to be coupled with each other on the basis of the least number of the pins. Please note that the arrangement of the pins in the plug and the receptacle of the first embodiment exchanges from that shown in FIGS. 8—10. The name of first, second, third and forth is only for distinguishing the pings and the connectors.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly, comprising:

a first connector and a second connector each defining a mating end of a regular polygon mating with each other, each regular polygon defining a centre, an imaginary circle around the centre and a plurality of vertices at the imaginary circle;

a plurality of pins located at the mating ends, the plurality of pins essentially comprising:

one first pin being at the centre of the first connector;

second pins at least fulfilling with one half of the vertices and arranged at adjacent vertices in turn;

one third pin being at the centre of the second connector;

two forth pins being at the vertices of the second connector respectively in a condition that said two forth pins spaced from each other with a largest distances.

2. The electrical connector assembly as described in claim 1, wherein the regular polygon of the second connector defines a diagonal line across the centre thereof, the forth pins are on the diagonal line.

3. The electrical connector assembly as described in claim 2, wherein the regular polygon has no diagonal line, one of the forth pins is at a first vertices thereof and the other of the forth pins is at another vertex which is nearest to an imaginary extending line from a connecting line between said first vertex and the centre.

4. The electrical connector assembly as described in claim 3, wherein the first connector has a metal ring surrounding the first pin and the second pins therein to define said mating end and the mating end is recessed inwards.

5. The electrical connector assembly as described in claim 4, where the first pin and the second pins each define a mating end and an abutting end, a spring means is set on the abutting end to urge the first and second pins to project outwards.

6. The electrical connector assembly as described in claim 5, wherein the first pin and the second pins each define a mating end with a recessed front end to receive corresponding mating end of the third pin and the forth pins.

7. The electrical connector assembly as described in claim 6, wherein the mating end of the second connector project outwards to be received in the metal ring of the first connector.

8. The electrical connector assembly as described in claim 6, wherein the second connector includes a metal shell and a permanent magnetic element covered by the metal shell.

9. An electrical connector assembly comprising:

a first connector and a second connector each defining a mating end mating with each other, each mating end defining a regular polygon with N sides defining a centre and vertices;

a plurality of pins located at the mating ends, the plurality of pins essentially comprising:

one first pin being at the centre of the first connector;

second pins at least fulfilling with one half of the vertices and arranged at adjacent continual vertices in turn;

one third pin being at the centre of the second connector;

two fourth pins being at the vertices of the second connector respectively in condition that the forth pins and the third pin located at one diagonal line with said two fourth pins being in a diametrically opposite manner with each other when N is even, while one of the forth pins is at one vertex and the other of the forth pin is at another vertex nearest to an imaginary extending line which extends from said one vertex to the centre when N is odd.

10. The electrical connector assembly as claimed in claim 9, wherein said another vertex is essentially one farthest vertex from said vertex.

11. The electrical connector assembly as claimed in claim 9, wherein when N is even, an amount of said second pins is exactly N/2; when N is odd, the amount of said second pins is (N+1)/2.

12. The electrical connector assembly as claimed in claim 11, wherein a sum of said second pins and said fourth pins is (N+4)/2 when N is even, or is (N+5)/2 when N is odd.

13. An interconnection system comprising:

a first connector defining a first polygonal interface with an N-number of first apexes and a first center wherein N is not less than 3;

a second connector defining a second polygonal interface corresponding to the first polygonal interface with also an N-number of second apexes with a second center aligned with the first center;

a first set of contact terminals arranged at both the first center and the first apexes with at least 2 apexes occupied; and a second set of contact terminals arranged at both the second center and the second apexes with at least N/2 apexes occupied when N is even, and at least (N+1)/2 apexes occupied when N is odd; wherein the second connector is configured to permit multiple orientations for mating with the first connector.

14. The interconnection system as claimed in claim 13, wherein the open apexes, which are not occupied by the second set of contact terminals, are arranged with a continuous manner in sequence.

15. The interconnection system as claimed in claim 13, wherein the two apexes of the first apexes, which are occupied by the first set of contact terminals, are spaced from each other with a largest distance among any two of said first apexes.

* * * * *